US006163883A

United States Patent [19]

Hong

[11] Patent Number: 6,163,883

[45] Date of Patent: Dec. 26, 2000

[54] GARMENT WITH MAGNETIC VENT CLOSURE

[76] Inventor: Jin S. Hong, 730 N. Mariposa St., Burbank, Calif. 91506

[21] Appl. No.: 09/416,740

[22] Filed: Oct. 13, 1999

[51] Int. Cl.[7] ..... A41B 1/00

[52] U.S. Cl. ..... 2/69; 2/85; 2/93; 2/DIG. 1

[58] Field of Search ..... 2/69, 93, 94, 108, 2/85, 247–251, 102, 87, 115, 79, DIG. 1, 69.5

[56] References Cited

U.S. PATENT DOCUMENTS

| | | | |
|---|---|---|---|
| 4,513,451 | 4/1985 | Brown | 2/69 |
| 5,507,042 | 4/1996 | Van Der Sleesen | 2/69 |
| 5,752,277 | 5/1998 | Van Der Sleesen | 2/69 |
| 6,085,353 | 7/2000 | Van Der Sleesen | 2/69 |

*Primary Examiner*—Gloria M. Hale
*Attorney, Agent, or Firm*—John K. Park; Park & Sutton LLP

[57] ABSTRACT

A garment with a magnetic vent closure comprises a clothing, a magnetic flipper, a vent window, a ferrous element and a removably attaching element. The magnetic flipper extends from a predetermined portion of the clothing and has a first end and a second end. The first end is detachably attached on the clothing and the second end is fixedly attached on the clothing, and the first end of the magnetic flipper comprises a magnetic element fixedly attached thereon. The vent window forms a part of the clothing and has a plurality of vent holes therethrough and the magnetic flipper is detachably applied over the plurality of vent holes. The ferrous element maintains the vent window in an opened state by magnetically capturing the first end of the magnetic flipper.

20 Claims, 3 Drawing Sheets

GARMENT WITH MAGNETIC VENT CLOSURE

BACKGROUND OF THE INVENTION

This present invention relates to a garment with a magnetic vent closure which enables a garment wearing individual to facilitate air ventilation through a vent window thereof with convenience by application of a magnetic element thereto.

As an increasing number of people evaluate outdoor activities, various function-focused garments are on the market. When on hiking, for example, the hiker needs to take off his/her jacket from time to time for cooling off the heated body. In particular, motorcycle riders suffer inconvenience due to a venting jacket according to the prior art which employs a zipper. Since a motorcycle rider typically wears gloves, it has been difficult to open the zipper during the motorcycle riding for air ventilation in the prior art.

Accordingly it is understood that air ventilation is in strong demand for garments which appeal to those who enjoy outdoor activities such as motorcycle riding and bicycle riding.

SUMMARY OF THE INVENTION

Therefore, it is an object of the present invention to provide a garment with a magnetic vent closure which increases efficiency in air ventilation for garments by allowing a garment wearing individual to facilitate air ventilation through a vent window thereof with convenience. Another object of the present invention is to apply magnets to the garment for easy manipulation in opening and closing actions of a magnetic flipper.

To achieve the above-described objectives, the garment with a magnetic vent closure according to this invention includes a clothing, a magnetic flipper, a vent window, a ferrous element, and a removably attaching means. The magnetic flipper extends from a predetermined portion of the clothing and has a first end and a second end. The first end is detachably attached on the clothing and the second end is fixedly attached on the clothing, and the first end of the magnetic flipper comprises a magnetic element fixedly attached thereon.

The vent window forms a part of the clothing and has a plurality of vent holes therethrough so that the magnetic flipper is detachably applied over the plurality of vent holes. The ferrous element is provided to maintain the vent window in an opened state by magnetically capturing the first end of the magnetic flipper and the element is located in a corresponding portion of the clothing to the magnetic element so that the first end of the magnetic flipper can be matching attached on the corresponding portion of the clothing when the magnetic flipper is detached from the vent window.

Meanwhile, the removably attaching means is provided to detachably maintain the vent window to be covered up and to be opened by the magnetic flipper. Here, the removably attaching means is formed along a vent peripheral of the vent window corresponding to a flipper peripheral of the magnetic flipper. Here, the removably attaching means may be selected from a hook-and-pile strap, a button-closed strap, a magnet-magnet combination, a magnet-ferrous combination and other commonly known detachably-closing materials.

In an improvement of the present invention, the first end of the magnetic flipper includes a plurality of magnetic elements which are magnets respectively poled opposite the ferrous element corresponding thereto. Further, the magnetic elements are fixedly attached on an outer lining or an inner lining of the first end of the magnetic flipper. The magnetic elements also may be fixedly embedded between the inner lining and the outer lining of the first end of the magnetic flipper. The clothing may vary to a jacket, a glove, pants and other applicable garments.

In another improvement of the present invention, the first end of the magnetic flipper includes a ferrous element fixedly attached thereon, and the magnetic element is located in a corresponding portion of the clothing to the ferrous element. Here, the first end of the magnetic flipper may include a plurality of ferrous elements which are respectively poled opposite the magnetic element corresponding thereto and fixedly attached on an outer or inner lining of the first end of the magnetic flipper. Further, the ferrous elements may be fixedly embedded between the inner lining and the outer lining of the first end of the magnetic flipper.

The advantages of the present invention are: (1) the garment wearing individual can enjoy his/her outdoor activities with continuous refreshment by the vent window built in the garment; (2) the vent window stably remains opened by the magnetic attraction between the magnetic element and the ferrous element when the magnetic flipper is detached from the vent window; (3) the magnetic vent closure can be applicable to various garments such as a jacket, a glove, pants and other sportswear.

Although the present invention is briefly summarized, the fuller understanding of the invention can be obtained by the following drawings, the detailed description and appended claims.

BRIEF DESCRIPTION OF THE DRAWINGS

The present invention will be better understood with reference to the accompanying drawings, wherein.

DETAILED DESCRIPTION OF THE PREFERRED EMBODIMENTS

With reference to the accompanying drawings, the preferred embodiments of the present invention will now be described.

Figure 1:
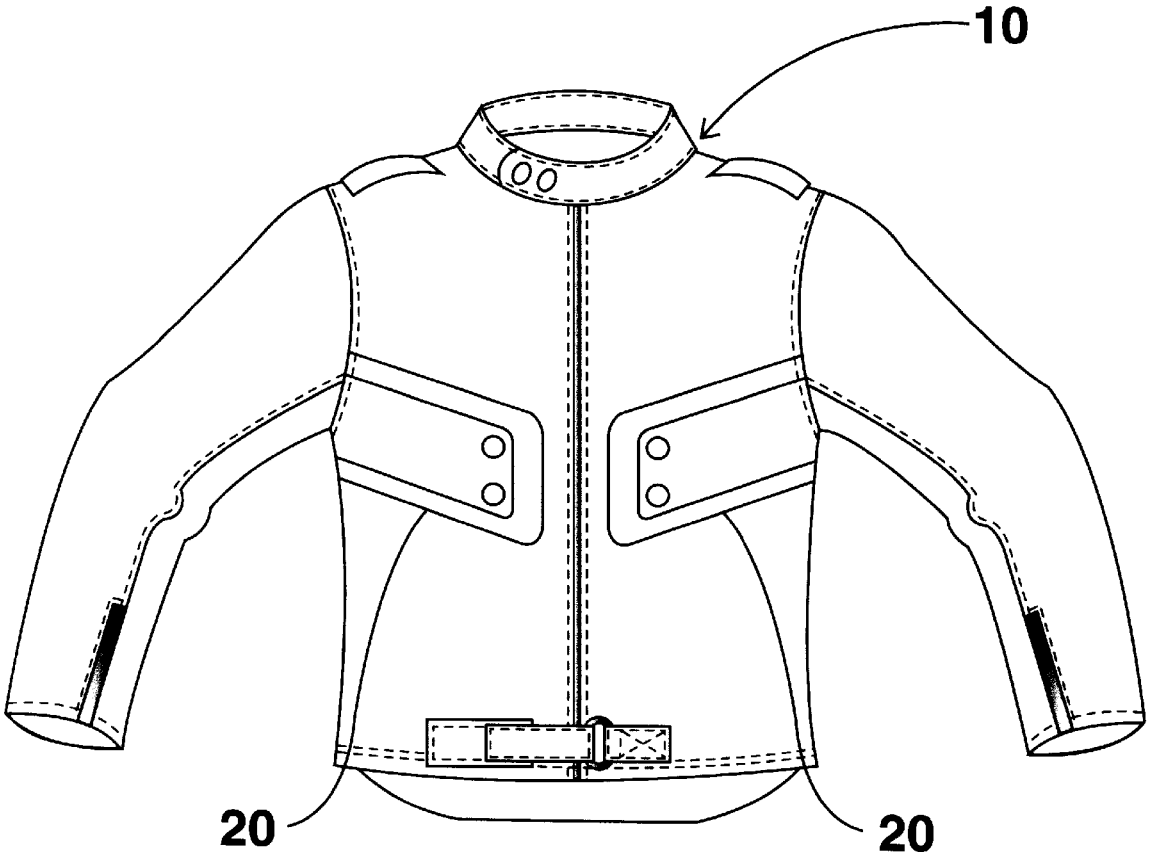
FIG. 1 is a front view illustrating a garment with a magnetic vent closure according to the present invention.
Figure 2:
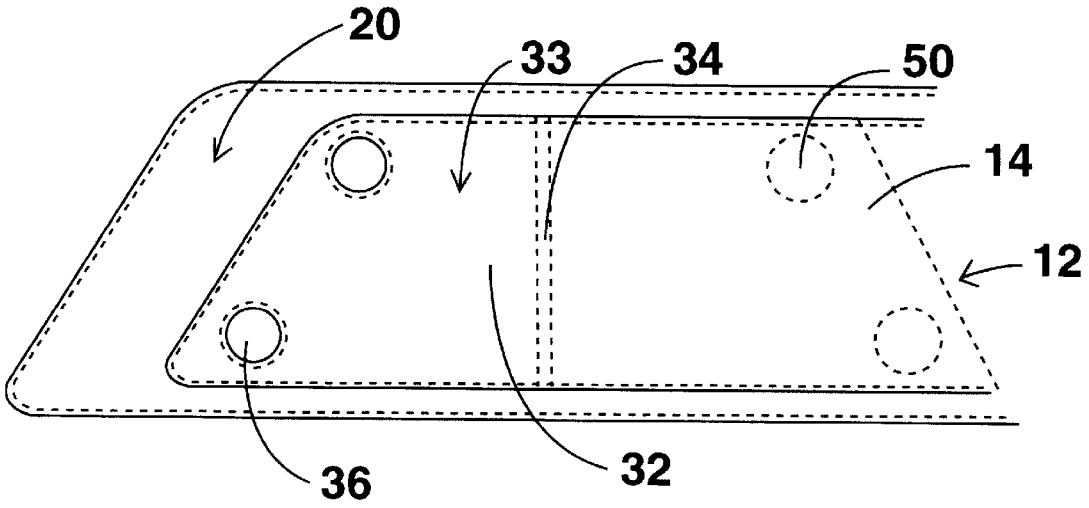
FIG. 2 is a plan view illustrating a magnetic vent closure according to the present invention.
Figure 3:
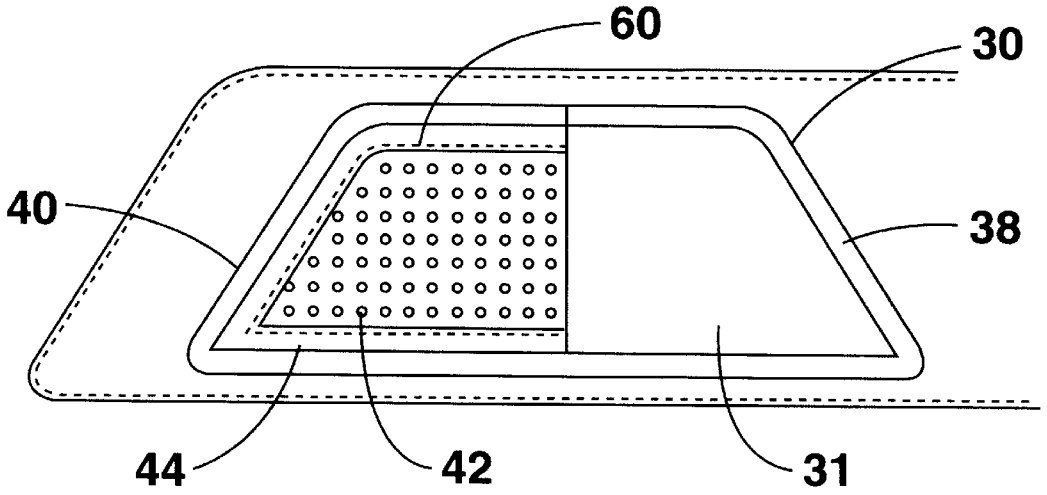
FIG. 3 is a plan view illustrating the magnetic vent closure with a vent window opened according to the present invention.
Figure 4:
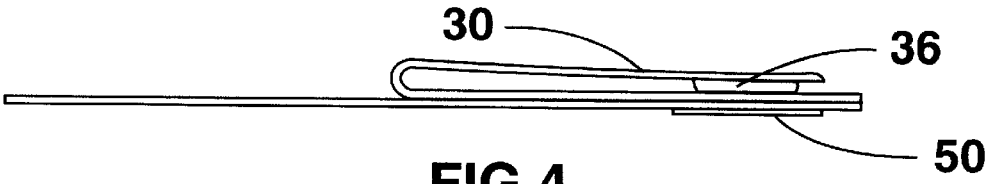
FIG. 4 is a schematic front view of FIG. 3.

As shown in FIG. 1, the clothing with a magnetic vent closure according to the present invention comprises a clothing 10 and a magnetic vent closure 20. As further shown in FIGS. 2, 3 and 4, the magnetic vent closure 20 is comprised of a magnetic flipper 30 and a vent window 40.

The magnetic flipper 30 extends from a predetermined portion 12 of the clothing 10 and includes a first end 32 and a second end 34. The first end 32 of the magnetic flipper 30 is detachably attached on the clothing 10 and the second end 34 of the magnetic flipper 30 is fixedly attached on the clothing. Here, the first end 32 of the magnetic flipper 30 has a magnetic element 36 fixedly attached thereon.

The vent window 40 forms a part of the clothing 10 and has a plurality of vent holes 42 formed therethrough. In such a construction, the magnetic flipper 30 is detachably applied over the plurality of vent holes 42.

Meanwhile, the magnetic vent closure 20 further comprises a ferrous element 50 and a removably attaching means 60. The ferrous element 50 is formed in a corresponding portion 14 of the clothing 10 to the magnetic element 36. Consequently, the first end 32 of the magnetic flipper 30 can be matching attached on the corresponding portion 14 of the clothing 10 when the magnetic flipper 30 is detached from the vent window 40.

In an embodiment of the present invention, the first end 32 of the magnetic flipper 30 may include a plurality of magnetic elements 36 which are magnets respectively poled opposite the ferrous element 50 corresponding thereto. Further, the plurality of magnetic elements 36 may be fixedly attached on either an inner lining 31 or an outer lining 33 of the first end 32 of the magnetic flipper 30. In addition, the plurality of magnetic elements 36 may be fixedly embedded between the inner lining 31 and the outer lining 33 of the first end 32 of the magnetic flipper 30.

The removably attaching means 60 is formed along a vent peripheral 44 of the vent window 40 corresponding to a flipper peripheral 38 of the magnetic flipper 30 so as to detachably maintain the vent window 40 to be covered up and to be opened by the magnetic flipper 30. Here, the removably attaching means 60 may be selected from a hook-and-pile strap, a button-closed strap, a magnet—magnet combination, a magnet-ferrous combination and other commonly known detachably-closing materials.

Figure 5:
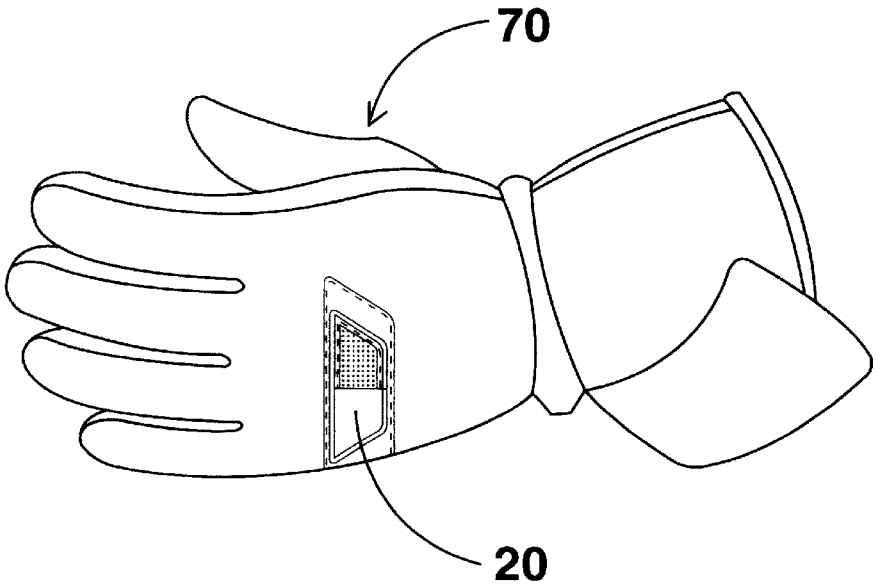
FIG. 5 is a view illustrating a glove with a magnetic vent closure according to the present invention.
Figure 7:
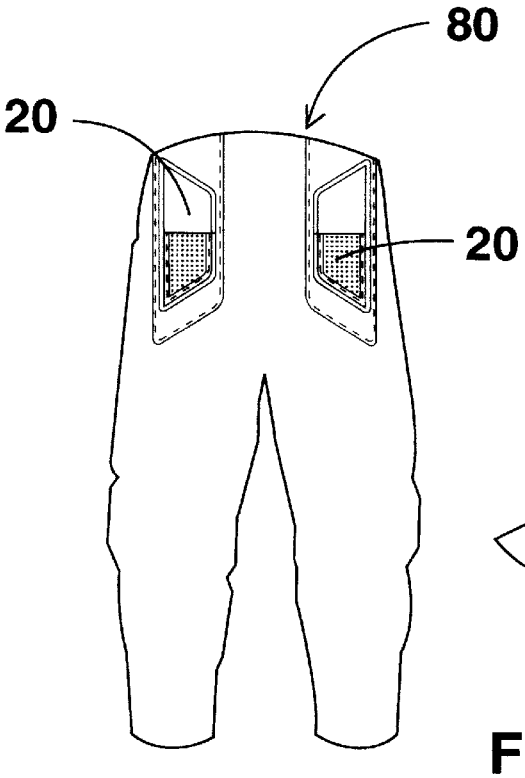
FIG. 7 is a view illustrating a headgear with a magnetic vent closure according to the present invention.
Figure 6:
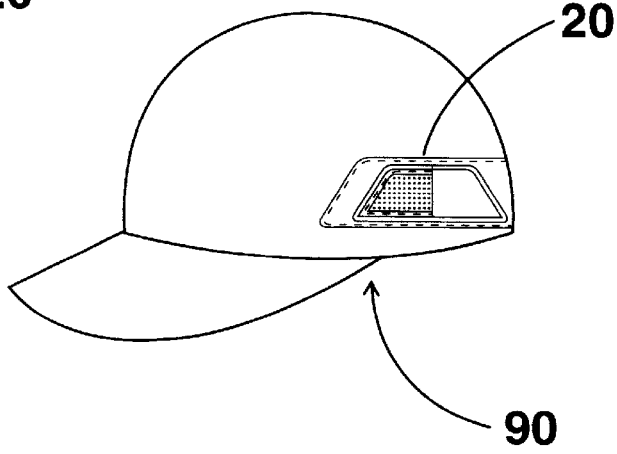
FIG. 6 is a view illustrating a pair of pants with magnetic vent closures according to the present invention.

As illustrated in FIGS. 5, 6 and 7, the magnetic vent closure 20 according to the present invention can further be applicable to a glove 70, a pair of pants 80, a headgear 90 and other commonly known garments.

In another embodiment of the present invention, respective composition materials of the magnetic element 36 and the ferrous element 50 may be switched with each other. That is, the magnetic element 36 can be replaced by the ferrous element 50 and the ferrous element 50 can be replaced by the magnetic element 36. Also, each of the switched elements 36, 50 may be formed plural in number.

Consequently, the garment with a magnetic vent closure according to the present invention enables a garment wearing individual to easily perform air ventilation through the vent window 40 which can be covered up by the magnetic flipper 30. Namely, when the magnetic flipper 30 is detachably covered over the vent window 40, the vent window 40 remains closed and stops air ventilation therethrough.

When manually opened up, the magnetic flipper 30 is magnetically attracted to the ferrous element 50 provided in the corresponding portion 14 thereto. That is, the magnetic element 36 of the magnetic flipper 30 remains opened by its magnetic attraction to the ferrous element 50 for thereby enabling the garment wearing individual to facilitate the air ventilation through the vent holes 42 of the vent window 40.

In particular, when applied to a motorcycle jacket, the magnetic vent closure according to the present invention shows a strong benefit over the prior art which employs a zipper. Since a motorcycle rider typically wears gloves, it has been inconvenient to open the zipper for air ventilation in the prior art. However, the magnetic vent closure according to the present invention enables a motorcycle rider to easily open the magnetic flipper with a glove wearing hand for fresh air ventilation by the magnetic attachment between the magnetic element and the ferrous element.

Other advantages of the present invention are: (1) the garment wearing individual can enjoy his/her outdoor activities with continuous refreshment by the vent window built in the garment, especially while riding a motorcycle; (2) the vent window stably remains opened by the magnetic attraction between the magnetic element and the ferrous element when the magnetic flipper is detached from the vent window; (3) the magnetic vent closure can be applicable to various garments such as jackets, gloves, pants, headgear and other sportswear.

Although the invention has been described in considerable detail with reference to certain preferred versions thereof, other versions are possible by converting the aforementioned construction. Therefore, the scope of the invention shall not be limited by the specification specified above and the appended claims.

What is claimed is:

1. A garment with a magnetic vent closure comprising:

a) a clothing;

b) a magnetic flipper extending from a predetermined portion of the clothing and having a first end and a second end, wherein the first end is detachably attached on the clothing and the second end is fixedly attached on the clothing, and wherein the first end of the magnetic flipper comprises a magnetic element fixedly attached thereon;

c) a vent window forming a part of the clothing, wherein the vent window has a plurality of vent holes therethrough, and wherein the magnetic flipper is detachably applied over the plurality of vent holes;

d) a ferrous element for maintaining the vent window in an opened state by magnetically capturing the first end of the magnetic flipper, wherein the ferrous element is located in a corresponding portion of the clothing to the magnetic element so that the first end of the magnetic flipper can be matchingly attached on the corresponding portion of the clothing when the magnetic flipper is detached from the vent window; and e) a removably attaching means for detachably maintaining the vent window to be covered up and to be opened by the magnetic flipper, wherein the removably attaching means is formed along a vent peripheral of the vent window corresponding to a flipper peripheral of the magnetic flipper.

2. The garment with a magnetic vent closure of claim 1, wherein the first end of the magnetic flipper comprises a plurality of magnetic elements.

3. The garment with a magnetic vent closure of claim 2, wherein the plurality of magnetic elements are magnets respectively poled opposite the ferrous element corresponding thereto.

4. The garment with a magnetic vent closure of claim 3, wherein the magnetic elements are fixedly attached on an outer lining of the first end of the magnetic flipper.

5. The garment with a magnetic vent closure of claim 3, wherein the magnetic elements are fixedly applied on an inner lining of the first end of the magnetic flipper.

6. The garment with a magnetic vent closure of claim 3, wherein the magnetic elements are fixedly embedded between the inner lining and the outer lining of the first end of the magnetic flipper.

7. The garment with a magnetic vent closure of claim 1, wherein the clothing is a jacket.

8. The garment with a magnetic vent closure of claim 1, wherein the clothing is a glove.

9. The garment with a magnetic vent closure of claim 1, wherein the clothing is a pair of pants.

10. The garment with a magnetic vent closure of claim 1, wherein the clothing is a headgear.

11. A garment with a magnetic vent closure comprising:

a) a clothing;

b) a magnetic flipper extending from a predetermined portion of the clothing and having a first end and a second end, wherein the first end is detachably attached on the clothing and the second end is fixedly attached on the clothing, and wherein the first end of the magnetic flipper comprises a ferrous element fixedly attached thereon;

c) a vent window forming a part of the clothing, wherein the vent window has a plurality of vent holes therethrough, and wherein the magnetic flipper is detachably applied over the plurality of vent holes;

d) a magnetic element for maintaining the vent window in an opened state by magnetically capturing the first end of the magnetic flipper, wherein the magnetic element is located in a corresponding portion of the clothing to the ferrous element so that the first end of the magnetic flipper can be matchingly attached on the corresponding portion of the clothing when the magnetic flipper is detached from the vent window; and e) a removably attaching means for detachably maintaining the vent window to be covered up and to be opened by the magnetic flipper, wherein the removably attaching means is formed along a vent peripheral of the vent window corresponding to a flipper peripheral of the magnetic flipper.

12. The garment with a magnetic vent closure of claim 11, wherein the first end of the magnetic flipper comprises a plurality of ferrous elements.

13. The garment with a magnetic vent closure of claim 12, wherein the plurality of ferrous elements are respectively poled opposite the magnetic element corresponding thereto.

14. The garment with a magnetic vent closure of claim 13, wherein the ferrous elements are fixedly attached on an outer lining of the first end of the magnetic flipper.

15. The garment with a magnetic vent closure of claim 13, wherein the ferrous elements are fixedly applied on an inner lining of the first end of the magnetic flipper.

16. The garment with a magnetic vent closure of claim 13, wherein the ferrous elements are fixedly embedded between the inner lining and the outer lining of the first end of the magnetic flipper.

17. The garment with a magnetic vent closure of claim 11, wherein the clothing is a jacket.

18. The garment with a magnetic vent closure of claim 11, wherein the clothing is a glove.

19. The garment with a magnetic vent closure of claim 11, wherein the clothing is a pair of pants.

20. The garment with a magnetic vent closure of claim 11, wherein the clothing is a headgear.

* * * * *